United States Patent [19]

Hermann

[11] Patent Number: 5,013,390

[45] Date of Patent: May 7, 1991

[54] HAND-HELD LABELLER

[76] Inventor: Klaus-Dieter Hermann, Ritterweg 17, D-6932 Hirschhorn, Fed. Rep. of Germany

[21] Appl. No.: 427,842

[22] PCT Filed: Apr. 1, 1988

[86] PCT No.: PCT/DE88/00209

§ 371 Date: Oct. 6, 1989

§ 102(e) Date: Oct. 6, 1989

[87] PCT Pub. No.: WO88/07960

PCT Pub. Date: Oct. 20, 1988

[30] Foreign Application Priority Data

Apr. 9, 1987 [DE] Fed. Rep. of Germany ..... 3711960

[51] Int. Cl.[5] ..... B65C 11/00

[52] U.S. Cl. ..... 156/577; 156/579; 156/DIG. 48

[58] Field of Search ..... 156/384, 577, 579, DIG. 48, 156/DIG. 49; 101/288

[56] References Cited

U.S. PATENT DOCUMENTS

| | | | |
|---|---|---|---|
| 3,231,446 | 1/1966 | Satas | 156/384 |
| 3,934,507 | 1/1976 | Geri | 156/384 |
| 3,960,642 | 6/1976 | Hamisch, Jr. et al. | 156/384 |
| 4,369,085 | 1/1983 | Hermann | 156/579 |
| 4,444,611 | 4/1984 | Becker | 156/384 |

FOREIGN PATENT DOCUMENTS

| | | |
|---|---|---|
| 0039781 | 11/1981 | European Pat. Off. . |
| 0059392 | 9/1982 | European Pat. Off. . |
| 2518782 | 11/1976 | Fed. Rep. of Germany . |
| 2638441 | 11/1977 | Fed. Rep. of Germany . |
| 3130378 | 2/1983 | Fed. Rep. of Germany . |

*Primary Examiner*—Michael Wityshyn

*Attorney, Agent, or Firm*—Cohn, Powell & Hind

[57] ABSTRACT

The invention relates to a hand-held labeling device (10) having a housing (11) and an operating lever (14) which is arranged for swinging about a first axis (13) and which in the rest position is swung away from a second handle (12) fixed to the housing, further a transport mechanism (34 to 36) for a label tape (31) which is operated during the swinging-out movement of the operating lever (14), the label tape being pulled off a supply roller (32) and run to the transport mechanism (34 to 36) over a guiding edge (33), a tape brake arranged between the supply roller (32) and the guiding edge (33) for fixing and releasing the label tape (31) in the longitudinal direction, the tape brake being provided with a brake lever (27) arranged to swing about a second axis, against the force of a first return spring (45) which, in the rest position of the movable handle (14), acts to press the label tape (31) against a guide plate (30), by the end (29) of the one arm of the brake lever (27), while the other arm of its lever coacts with the movable handle (14) in such a manner that operating this handle will cause the tape brake formed by the other arm (29) to be lifted. The invention consists in the fact that a lever (22) actuated by the operating lever (14) carries an element (57) which acts, in addition to the return spring (45), to fix the brake lever (27) in the rest position, in the rest position of the operating lever (14).

5 Claims, 2 Drawing Sheets

HAND-HELD LABELLER

The present invention relates to a hand-held labeling device having a housing and an operating lever which is arranged for swinging about a first axis and which in the rest position is swung away from a handle fixed to the housing, further a transport mechanism for a label tape which is operated during the swinging-out movement of the operating lever, the label tape being pulled off a supply roller and run to the transport mechanism over a guiding edge, a tape brake arranged between the supply roller and the guiding edge for fixing and releasing the label tape in the longitudinal direction, the tape brake being provided with a brake lever arranged to swing about a second axis, against the force of a first return spring which, in the rest position of the operating lever, acts to press the label tape against a guide plate, by the end of the one arm of the brake lever, while the other arm of its lever coacts with the operating lever in such a manner that operating this lever will cause the tape brake formed by the other arm to be lifted.

A hand-held labeling device of this type has been known already from DE-OS 26 38 441.

In the case of the known hand-held labeling devices the label gets detached from the carrier tape as the latter is pulled around a pointed guiding edge. During the detaching process, the label is transported to a position immediately below a pressure roller and can be pressed upon the object to be labeled even before it has fully come off the carrier tape. At the beginning of the pressing process, a large part of the label is still sticking to the carrier tape, due to the immediate vicinity of the guiding edge to the pressure roller, this part being the larger the longer the label is, viewed in the direction of the carrier tape.

Hand-held labeling devices of this type are frequently used for labeling a large number of objects arranged one beside the other, in rapid sequence. In supermarkets, for example, carton boxes containing a large quantity of individual cartons or cans are opened on top, and the individual cartons or cans are labeled one after the other, in rapid sequence. As a result of the speed of this operation, and the abrupt movements connected therewith, considerable stress is exerted upon the carrier tape, which stress is the greater the longer the section of the label still sticking to the carrier tape is. As a result, the exact timing of the movement of the carrier tape by the transport mechanism, which is indispensable if the individual labels are to be printed in good register, may be heavily impaired, in particular when the label tape is pulled off the supply roller in an uncontrolled manner, due to the stress exerted upon the carrier tape.

For the above reasons, tape brakes of the most different kinds have already been proposed, when become active at different points in time during the usual operating cycle of a hand-held labeling device. At the beginning of such a usual operating cycle, the operating lever, which is adapted to swing relative to the housing, is initially retracted from its swung-out position which it occupies in the rest condition. During such retracting motion, a printing mechanism accommodated in the hand-held labeling device is pivoted and caused to print one label at the time. The user then releases the fully retracted operating lever so that the latter is returned to its swung-out end position by the action of a return spring. During this outward movement, the transport mechanism is operated and caused to advance the label tape by one register step (label length), and during this transport movement the label gets detached from the carrier tape as it passes the guiding edge.

In the case of a known hand-held labeling device of the type described by the before-mentioned DE-OS 26 38 441 the swinging operating lever ends at its front by two narrow supporting arms carrying a printing head at their forward free ends. The supporting arms are interconnected, near their forward free ends, by a shaft extending in transverse direction. For the purpose of braking, i.e. selectively fixing and releasing, the label tape in the longitudinal direction, a two-armed brake lever is provided which acts to press the label tape against a guide plate fixed to the housing. A brake lever element is biassed continuously by a spring so as to exert a certain pressure continuously upon the label tape. A second brake lever element is engaged by a leg spring subjected to a relatively high biassing force, which in the rest position of the brake lever acts to urge a brake shoe at high force upon the label tape resting on the guide plate. Another, upwardly pointing lever arm of the same brake lever is provided at its face with contoured guiding elevations, and the shaft interconnecting the supporting arms of the printing head rests against the front of these contoured elevations. Now, when the swinging operating lever is retracted, the shaft moves downwardly along the elevations and causes the brake lever to pivot against the force of the leg spring so that the brake shoe is lifted off the label tape. This action occurs twice during each labeling cycle, in the case of the known hand-held labeling device, namely once when the swinging handle is retracted and when the shaft moves downwardly along the elevations and—for reasons of symmetry—once more when the handle moves outwardly and when the shaft returns in upward direction, along the same elevations, into its rest position.

However, the known hand-held labeling device is connected with the drawback that in the rest position, when the operating lever occupies its swung-out position, the braking force is determined exclusively by the force of the leg spring biassing the brake lever. If, therefore, the greatest possible braking force is to be obtained, in order to prevent the label tape from being pulled out inadvertently, then the leg spring must be correspondingly strong. This leads, however, to the disadvantage that the force required for actuating the hand-held labeling device becomes correspondingly important as the brake lever must be deflected for each dispensing process, against the force of the leg spring. However, the force required for actuating the hand-held labeling device may not get too high, as the users of such devices must operate them many times during their work so that every reasonable effort must be made to avoid fatigue. It would of course be possible to reduce the operating force even for a strong leg spring, by sizing the lever arms of the brake lever appropriately, but this is hardly possible for reasons of space, and this the more as the brake lever should be actuated in a defined manner and only over a limited swinging range of the swinging handle, so that one is not free to select the dimensions of the lever arms of the brake lever at desire.

DE-AS 25 18 782 describes another hand-held labeling device comprising again a brake lever arranged to swing about an axis fixed to a housing. The brake lever is pivoted by a transport bow which in turn is actuated by the swinging operating lever. The kinetics of this arrangement are such that the brake is released during the entire motion sequence of the swinging operating lever—except in its rest position—so that the label tape may be pulled off its defined position and out of register.

Another known hand-held labeling device described by DE-OS 31 30 378 makes use of a design similar to that of the hand-held labeling device according to DE-AS 25 18 782, except that the brake lever is not directly actuated by the swinging operating lever. Rather, in the case of this known hand-held labeling device, a spring urges one lever end against the label tape, and the latter against a roller. Now, when the operating lever is retracted, a projection on the handle comes to engage the brake lever in the retracted end position so as to lift it off the label tape. At the same time, a locking element, by which the brake lever had been held in position, is released so that the brake lever remains released also during the swinging-out movement of the operating lever. It is only at the end of the swinging-out movement that the locking element is locked and the brake is engaged again.

Although in the case of this hand-held labeling device the tape brake is released only during the swinging-out movement of the operating lever, exact synchronization with the transport mechanism is neither intended nor possible, and the braking force also cannot be adjusted in the desirable manner in the engaged position of the tape brake.

In the case of a hand-held labeling device known from DE-PS 30 17 843, the brake lever, which is adapted to swing about an axis, is provided at its front with a control edge coacting with a control element in the form of a shaft arranged between two supporting arms carrying the printing mechanism, in a manner similar to that described above in connection with the hand-held labeling device known from DE-OS 26 38 441. However, when the operating lever is retracted, the control element is lifted off the control edge and returned to its position on the control edge only when the operating lever has almost reached its fully retracted position. At the same time, there is provided a locking arm which—in a manner similar to the locking element of the hand-held labeling device according to DE-OS 31 30 378 described before—is capable of locking the brake lever in its released position. These elements of the hand-held labeling device according to DE-PS 30 17 843 lead to the condition that the tape brake is released once the operating lever has been retracted by a given angle and that this released condition remains unchanged until the lever has been restored again to its fully released condition. However, this also provides the disadvantage that the brake is in the released condition over a very long swinging range of the handle, i.e. over a range which is much longer than the one in which the transport mechanism is actuated.

Finally, EP-PS 0 059 392 describes still another hand-held labeling device where a feeding slide for the label tape, which can be displaced linearly, carries at its forward end a hook which comes to embrace a brake lever when the feeding slide has reached its foremost end position with the operating lever in the retracted position, so as to move the brake lever away from the label tape as the feeding slide travels back in rearward direction when the operating lever swings back to its open position. This means that in the case of this known hand-held labeling device, too, the tape brake is released during the whole swinging movement of the operating lever.

Now, it is the object of the present invention to improve a hand-held labeling device of the type described above in such a manner as to ensure that even when labels are dispensed in rapid succession no label tape will be pulled off the supply roller when the operating lever occupies its outer open rest position, and that on the other hand this advantage has not to be paid for by an increase in the force required for actuating the hand-held labeling device.

This object is achieved according to the invention by an arrangement in which a lever actuated by the operating lever carries an element which acts, in addition to the return spring, to fix the brake lever in the rest position in the rest position of the operating lever.

This solves the object underlying the invention fully and perfectly because in the open position of the operating lever the brake lever is held in position not only by the force of a leg spring, but in addition by form-locking means, so that the tape brake will always remain applied to the label tape, exerting its full braking force, even when the device should be subjected to heavy shocks during operation.

According to a preferred embodiment of the invention, the element, which is actuated by the operating lever, comprises an inclined surface acting as a wedge which is contacted by a stop arranged on the brake lever at least over the last part of the movement leading to the rest position of the operating lever and which in this rest position acts to urge the brake lever into the latter's rest position, by the action of its inclined surface. Consequently, the brake lever is retained not only by the force of a leg spring, but in addition also by the wedging effect. Moreover, this arrangement makes it possible to adjust almost any desired braking force by selecting appropriate wedge angles.

In particular, the element actuated by the operating lever is arranged on two parallel bars forming extensions of the lever, and the bars are provided on their upsides with an arc-shaped recess, one section of which forms the wedge surface.

These features offer the advantage to provide a particularly space-saving and effective arrangement where the narrow lever arms anyway present are used, by providing an arc-shaped recess, for implementing a wedge surface serving as low-friction contact surface for the pin.

Other advantages of the invention will appear from the specification and the attached drawing.

It is understood that the features that have been described before and will be explained hereafter may be used not only in the described combinations, but also in any other combination, or individually, without leaving the scope and intent of the present invention.

One embodiment of the invention will now be described in more detail with reference to the drawing in which.

Figure 1:
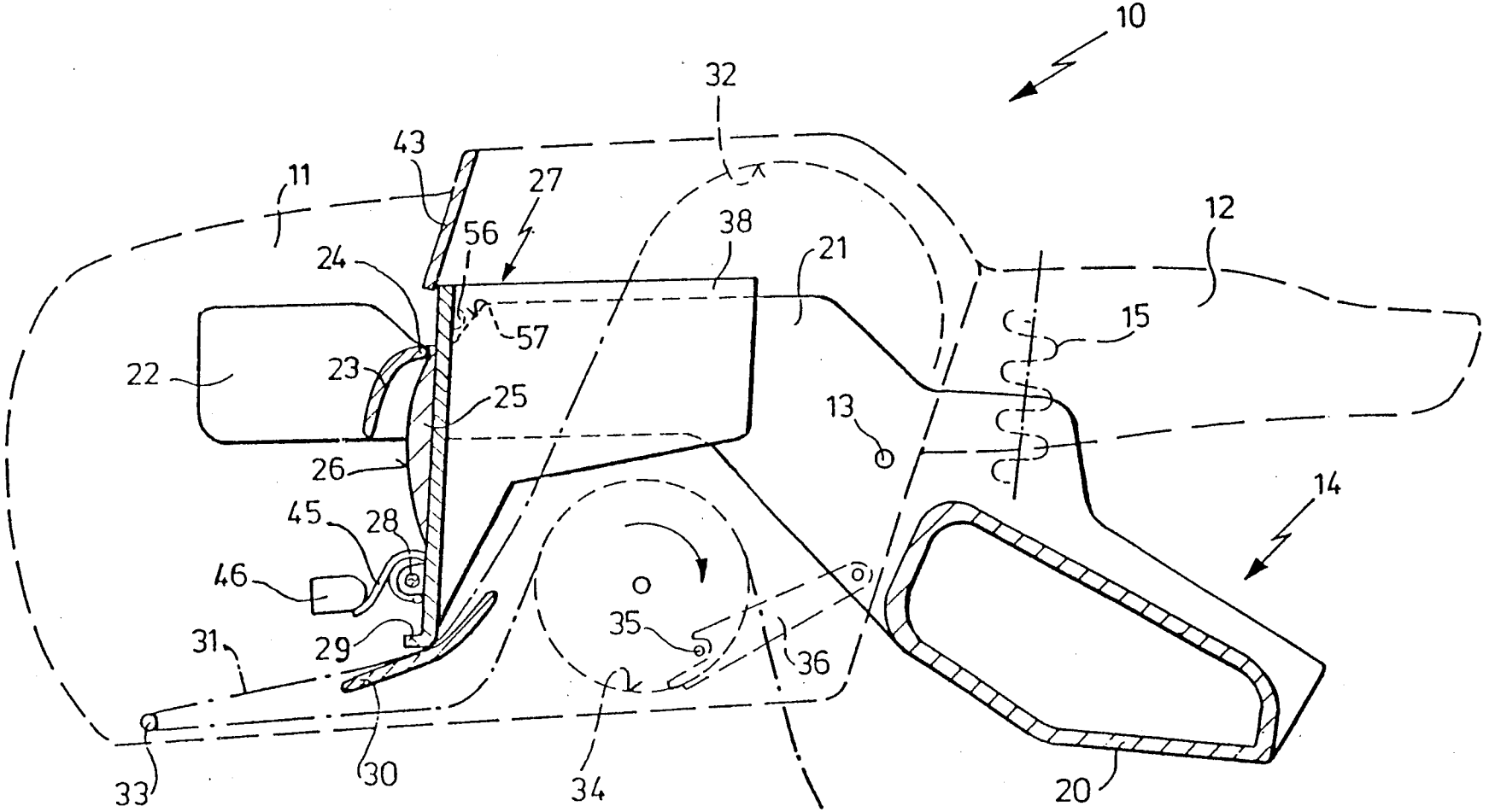
FIG. 1 shows a very diagrammatic side view of one embodiment of a hand-held labeling device according to the invention.

Regarding now FIG. 1, a hand-held labeling device indicated generally by reference numeral 10 comprises a housing 11, which is indicated only diagrammatically and which may, for example, be made from plastic and consist of a single piece or of two halves. The rear portion of the housing 11 is provided with an integrally formed handle 12. A movable operating lever 14 is arranged in the rear portion of the housing 11. It is pivoted about a first axis 13 fixed to the housing and urged into its open outer position, i.e. its rest position shown in FIG. 1, by means of a return spring 15.

The operating lever 14 has a handle portion 20 projecting from the housing 11 which can be gripped by the user for the purpose of retracting it toward the handle 12 fixed to the housing, by compressing simultaneously the return spring 15, and permitting it thereafter to return to its rest position under the action of the return spring 15.

On the other side of the first axis 13, the operating lever 14 comprises a lever arm which projects forwardly into the housing 11 and which is formed by two lateral narrow lever bars 21 which are pivoted upwardly and downwardly about the first axis 13, along the inside of the side walls of the housing 11, when the handle portion 20 is retracted or released to return to its rest position. The forward free ends 22 of the lever bars 21 carry a conventional printing mechanism which is not in detail shown in FIG. 1.

The lever bars 21 are interconnected in the area of the forward free ends 22 by a crosspiece 23. The crosspiece 23 is angle-shaped, and one end 24 of the crosspiece 23 projecting horizontally in the direction of the movable handle 14 rests on a profiled piece 25 provided with an arc-shaped contour 26. The profiled piece 25 in turn is arranged on a brake lever 27.

The brake lever 27 is arranged to pivot about a second axis 28 fixed to the housing. A lower lever arm of the brake lever 27 serves as a brake shoe 29 located opposite a guide plate 30 fixed to the housing.

A label tape 31 runs from a supply roller 32 in the upper portion of the housing 11 through the space between the brake shoe 29 and the guide plate 30 and to a forward pointed guiding edge 33, and from there back through the bottom area of the housing 11 and rearwardly to a feeding roller 34. The feeding roller 34 is provided, for example, with laterally projecting pins 35 which are engaged by a driving pawl 36 actuated in the conventional manner by the movable handle 14.

The arrangement of FIG. 1 is such that the brake shoe 29 presses the label tape 31 upon the guide plate 30 so as to fix it in the longitudinal direction.

As can be further seen in FIG. 1, the brake lever 27 ends at the rear by two plate-shaped free ends 38 resting laterally against the lever bars 21 so as to prevent any tilting of the brake lever 27.

A leg spring 45 has one end resting against a stop 46 fixed to the housing, while its other end loads the brake lever 27 in counterclockwise direction, as viewed in FIG. 1, so that the brake shoe 29 urges the label tape 31 firmly against the guide plate 30 in the rest position.

Figure 2:
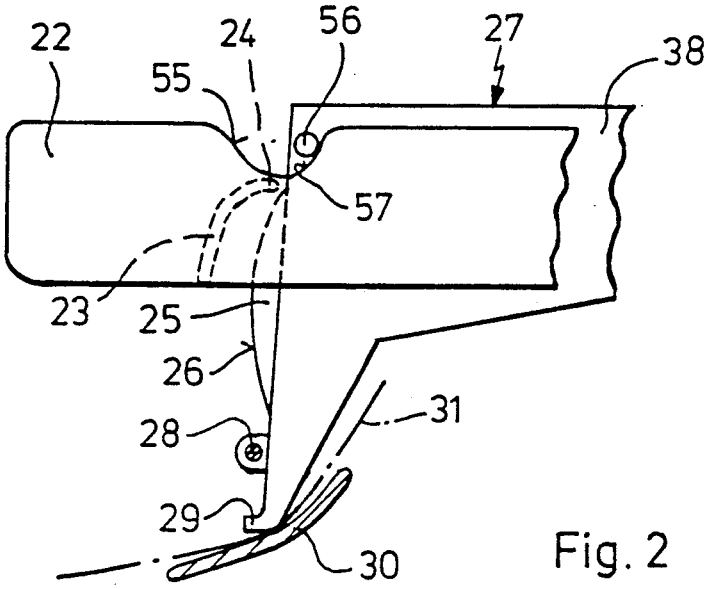
FIGS. 2 and 3 show two motion phases illustrating the operation of the hand-held labeling device according to the invention.
Figure 3:
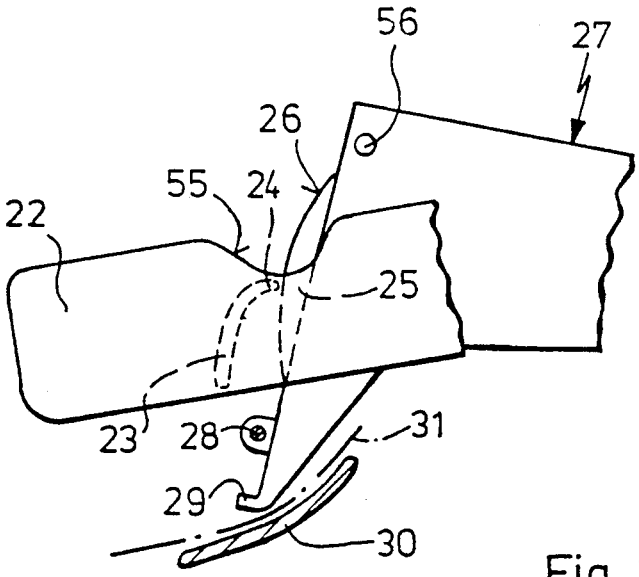

FIGS. 2 and 3 illustrate those details, while are essential for the operation of the brake lever 27, by a view similar to that of FIG. 1, but slightly offset to the top relative to the drawing plane of FIG. 1, i.e. up to the forward free end 22 of the extension of the operating lever 14.

It is readily seen that the free ends 22, which takes the form as narrow bars, are provided on their tops with arc-shaped recesses 55 which are engaged by pins 56 of the brake lever 27. The pins 56 project laterally from both sides of the upper edge of the brake lever 27. In the open rest position of the operating lever 14 shown in FIG. 2, the pins 56 rest against a surface of the arc-shaped recess 55 which acts as a wedge surface 57. It is known that in the outer extracted rest position of the operating lever 14, the latter is pivoted by the force of the relatively strong return spring 15 in clockwise direction, up and against a stop fixed to the housing, and the swinging movement of the free ends 22 in clockwise direction has the effect that when the wedge surface 57 is sized conveniently the pin 56 is pivoted about the second axis 28 in counterclockwise direction so that the pressing force exerted by the brake shoe 29 is clearly increased beyond the effect of the leg spring 45. The total pressure of the brake shoe 29 so obtained secures the label tape 31 very efficiently against inadvertent displacement in the longitudinal direction.

Now, when the hand-held labeling device 10 is actuated by retracting the operating lever 14, the latter is pivoted about the first axis 13 in clockwise direction, and the free ends 22 move downwardly, as can be seen in FIG. 3. This has the effect that on the one hand the wedging effect between the pins 56 and the wedge surface 57 is released so that the pressure exerted upon the label tape 31 slackens. In addition, the forward end 24 of the crosspiece 23 slides along the contour 26 of the profiled piece 25, the arrangement and sizing being such that the brake lever 27 is pivoted in this manner in clockwise direction, as can be clearly seen in FIG. 3. Finally, the brake shoe 29 is lifted off the guide plate 30 and/or the label tape 31 so as to release the latter.

I claim:

1. A hand-held labeling device (10) having a housing (11) and a movable handle (14) which is arranged for swinging about a first axis (13) and, in a rest position, said movable handle being swung away from a second handle (12) fixed to the housing, a transport mechanism (34 to 36) for a label tape (31) said mechanism being operated during movement of the said movable handle (14) to said rest position, a supply roller (32) carried in the upper portion of the housing, a tape dispensing edge (33) carried within the housing, the said label tape being pulled off the supply roller (32) and run to the said transport mechanism (34 to 36) over the dispensing edge (33), a tape brake including a brake lever (27) having opposed arms one of said arms having an end (29) and a guide plate (30) arranged between the said supply roller (32) and the said dispensing edge (33) for fixing and releasing the said label tape (31) in a direction longitudinal of the tape, the said brake lever (27) being arranged to swing about a second axis against the force of a first return spring (45), the spring in the rest position of the said movable handle (14), acting to press the said label tape (31) against the guide plate (30) by the end (29) of the one arm of the said brake lever (27), while the other arm of the lever coacts with the said movable handle (14) in such a manner that operating the movable handle will cause the end (29) of the one arm of the breake lever to be lifted, characterized in that a lever (22) actuated by the said movable handle (14) carries an element (55) which acts, in addition to the said return spring (45), to fix the said brake lever (27) in a rest position, in the rest position of the said movable handle (14).

2. Device according to claim 1, characterized in that a stop (56) is arranged on said brake lever (27) and the said element (55), which is actuated by the said movable handle (14), comprises an inclined surface (57) on said lever (22) acting as a wedge which is contacted by said stop (56) arranged on the said brake lever (27) at least over the last part of the movement leading to the rest position of the said movable handle (14), said movable handle (14) in this rest position acting to urge the said brake lever (27) into its rest position, by the action of said inclined surface on said stop.

3. Device according to claim 2 characterized in that the said element (57) actuated by the said movable handle (14) is arranged on two parallel bars (21,22) forming extensions of the said movable handle (14), and that the said bars (21, 22) include upsides and are provided on their upsides with an arc-shaped recess (55) having one section which forms the said inclined surface (57).

4. Device according to claim 2, characterized in that the said stop (56) coacting with the said inclined surface (57) takes the form of a pin arranged on the said brake lever (27).

5. Device according to claim 4, characterized in that the said element (57) actuated by the said movable handle (14) is arranged on two parallel bars (21,22) forming extensions of the said movable handle (14), and that the said bars (21,22) include upsides and are provided on their upsides with an arc-shaped recess (55) having one section which forms the said inclined surface (57).

* * * * *